US010309065B2

(12) United States Patent
Berg et al.

(10) Patent No.: US 10,309,065 B2
(45) Date of Patent: Jun. 4, 2019

(54) RUBBER TIRE ROLLER

(71) Applicant: BOMAG GmbH, Boppard (DE)

(72) Inventors: Christian Berg, Voelkenroth (DE); Ernst-Josef Einolf, Boppard (DE); Thomas Haubrich, Goedenroth (DE); Thomas Klein, Wehr (DE); Tobias Schonberg, Oberelbert (DE)

(73) Assignee: BOMAG GmbH, Boppard (DE)

( * ) Notice: Subject to any disclaimer, the term of this patent is extended or adjusted under 35 U.S.C. 154(b) by 199 days.

(21) Appl. No.: 15/621,005

(22) Filed: Jun. 13, 2017

(65) Prior Publication Data

US 2017/0356139 A1 Dec. 14, 2017

(30) Foreign Application Priority Data

Jun. 13, 2016 (DE) ..... 10 2016 007 170

(51) Int. Cl.

| | |
|---|---|
| ***E01C 19/23*** | (2006.01) |
| ***E01C 5/08*** | (2006.01) |
| ***E02D 3/032*** | (2006.01) |
| ***E01C 19/27*** | (2006.01) |
| *E01C 19/30* | (2006.01) |

(52) U.S. Cl.

CPC ..... *E01C 19/236* (2013.01); *E01C 5/085* (2013.01); *E01C 19/233* (2013.01); *E01C 19/27* (2013.01); *E02D 3/032* (2013.01); *E01C 19/30* (2013.01)

(58) Field of Classification Search

CPC ..... E01C 19/23; E01C 19/28
USPC ..... 404/117, 122, 132; 180/20
See application file for complete search history.

(56) References Cited

U.S. PATENT DOCUMENTS 2,721,405 A * 10/1955 Gardner ..... E01C 19/27 172/292
3,228,312 A * 1/1966 Neidhardt ..... B60K 17/34 180/23
3,249,027 A * 5/1966 Peterson ..... B62D 61/10 180/20
3,298,292 A * 1/1967 Wylie ..... E01C 19/26 404/122

(Continued)

FOREIGN PATENT DOCUMENTS

DE 102012015889 A1 2/2014
DE 112012004404 T5 7/2014

(Continued)

OTHER PUBLICATIONS

LeeBoy 420 rollers sale listings https://www.rockanddirt.com/aucsearch?method =search&type=E&catnum=1015&makeovr=LEEBOY&model=420.*

(Continued)

*Primary Examiner* — Thomas B Will
*Assistant Examiner* — Katherine J Chu
(74) *Attorney, Agent, or Firm* — Wood Herron & Evans LLP

(57) ABSTRACT

The present invention relates to a rubber tire roller for ground compaction, comprising a machine frame and an operating platform and front and rear undercarriages supporting the machine frame, wherein the undercarriages each comprise at least one wheel. A fundamental idea of the present invention lies in viewing indentations that are open to the side.

17 Claims, 7 Drawing Sheets

(56) References Cited

U.S. PATENT DOCUMENTS 3,324,583 A * 6/1967 Harris ..... E02F 3/84 172/292
3,844,671 A * 10/1974 Domenighetti ..... B62D 53/02 404/117
3,890,056 A * 6/1975 Domenighetti ..... E01C 19/233 404/117
4,157,877 A * 6/1979 Lee ..... E01C 19/231 172/395
4,260,280 A * 4/1981 Hirn ..... B62D 21/186 180/20
4,530,620 A * 7/1985 McCartney ..... B60B 15/02 301/43
5,261,213 A * 11/1993 Humphrey ..... A01D 34/62 404/117
5,664,909 A * 9/1997 Lindgren ..... E01C 19/26 180/326
6,857,816 B2 * 2/2005 Saito ..... E02D 3/039 180/9.21
7,540,685 B2 * 6/2009 Avikainen ..... B62D 33/0636 180/327
7,674,070 B2 * 3/2010 Fluent ..... B06B 1/166 404/122
8,602,679 B2 * 12/2013 Roetsch ..... B62D 33/0625 404/113
8,770,887 B1 * 7/2014 Geier ..... E01C 19/286 200/61.54
9,423,332 B2 * 8/2016 Corcoran ..... G01N 9/36
9,630,657 B2 * 4/2017 Ries ..... B62D 25/163
2012/0155961 A1 * 6/2012 Norton ..... E01C 19/26 404/75
2018/0100275 A1 * 4/2018 Ries ..... E01C 19/238
2018/0274194 A1 * 9/2018 Stromsoe ..... E02D 3/026

FOREIGN PATENT DOCUMENTS

EP 0864694 A2 9/1998
EP 2 698 473 A2 2/2014
JP 2000290919 A 10/2000
JP 2001140210 A 5/2001
JP 2005344288 A 12/2005

OTHER PUBLICATIONS

LeeBoy 420B Pneumatic Roller brochure.*
Compaction Equipment, Figures 3 and 4 https://www.pavementinteractive.org/reference-desk/construction/compaction/compaction-equipment/.*
Hamm AG, Brochure for Innovation auf 8 Radern, Serie GRW 180/280, Tirschenreuth, Germany, dated Apr. 2016 (10 Pages).
German Patent Office, Search Report for Application No. 102016007170.2, dated Mar. 29, 2017 (7 pages).
Hamm AG, English Translation of Brochure for Innovation on 8 wheels, Series GRW 180/280, Tirschenreuth, Germany, dated Apr. 2016 (10 Pages).

* cited by examiner

RUBBER TIRE ROLLER

CROSS-REFERENCE TO RELATED APPLICATION

The present application claims priority under 35 U.S.C. § 119 of German Patent Application No. 10 2016 007 170.2, filed Jun. 13, 2016, the disclosure of which is hereby incorporated herein by reference in its entirety.

FIELD OF THE INVENTION

The present invention relates to a rubber tire roller for ground compaction.

BACKGROUND OF THE INVENTION

A generic rubber tire roller is known, for example, from EP 0 864 964 A2. Rubber tire rollers are ground compaction machines equipped with wheels, usually rubber wheels, with which they drive over a ground to be compacted. To this end, generic rubber tire rollers comprise a machine frame with an operating platform and front and rear undercarriages supporting the machine frame, the undercarriages respectively comprising at least one wheel. The indications "front" and "rear" relate here to the forward direction of the rubber tire roller, the rubber tire roller normally being driven over the ground alternately forward and backward during operation. The elastic properties of the wheels give rise to an advantageous rolling or kneading effect, by means of which a particular homogenous compaction of the ground surface and an advantageous closing of the pores on the ground surface can be attained. Generic rubber tire rollers are used both in earthworks and asphalt construction and are used for compacting a supporting layer of a road. The compaction effect of a rubber tire roller occurs primarily as a result of its own weight and is influenced by the same. In order to attain a wheel load required for a desired compaction performance, the rubber tire rollers need to have a high machine weight. The machine weight of the rubber tire rollers can consequently frequently be increased by attaching additional weights on the machine frame. At the same time, the machine should be configured to be as compact as possible, which has led to the machine frame of generic rubber tire rollers typically being comparatively massive or bulky.

During ground compaction, it is advantageous for the driver of the rubber tire roller to be able to observe the outer wheel edges as well as the tread of the wheels. The wheel edges are important in order to maneuver the rubber tire roller along a desired path as precisely as possible, while observing the wheel tread permits an early recognition of whether ground material is adhering to the tires, which could undesirably lead to an uneven ground surface. It is known in the prior art to equip the rubber tire rollers with mirrors and/or cameras, by means of which these areas of the wheel can be observed. Said visual supports, however, get dirty comparatively quickly, while the driver of the rubber tire roller recognizes considerably fewer details regarding the position of the wheel edges or material sticking to the wheel treads when images are conveyed by way of cameras and mirrors as is the case when the relevant areas can be viewed directly. It is also known in the prior art to use viewing tunnels through which the driver of the rubber tire roller may have a direct view of the wheels or their wheel treads. Said tunnels extend exclusively inside the machine and are, with the exception of two openings, one in the direction of the operating platform and one in the direction of the wheels, closed to the outer environment. This solution has the disadvantage that forming tunnels inside the machine frame is relatively complex, requires a lot of construction space and moreover only permits a very limited view of the wheel edges or tread of the wheels for the driver. In addition, said tunnels have to be partially illuminated in order to allow the driver to view the wheels at all.

Against this background, it is the object of the present invention to improve the viewing conditions on existing rubber tire rollers. In particular, it is the object of the present invention to allow the driver to view the relevant areas such as the wheel edges and tread of the outer wheels directly from the operating platform. The improved visibility conditions should also not result in a more complex structure of the machine, should not excessively reduce the construction space available within the machine frame and, as far as possible, should not require further components such as, e.g., lighting equipment.

SUMMARY OF THE INVENTION

Specifically, the object is achieved in a generic rubber tire roller described above in that at least one viewing indentation for the front undercarriage is formed in the machine frame, wherein the viewing indentations are configured to be laterally open over their entire extension, wherein an outer wheel edge and a wheel tread of the at least one wheel of the front undercarriage can respectively be observed by a driver of the rubber tire roller from the operating platform through the viewing indentations and wherein the viewing indentation is configured in such a way that, viewed in the forward direction, it initially widens in the horizontal plane toward the middle of the machine and then narrows away from the middle of the machine. The viewing indentation thus provides a viewing channel enabling a free field of vision from the operating platform to the at least one wheel for a driver present on the operating platform. The visible wheel edge is one of the two front-side wheel edges of the undercarriage, which are located at the outermost points on the rubber tire roller. Said wheel edges are of particular importance when the rubber tire roller has to be maneuvered along a specific path or, e.g., close to obstacles. Of relevance, here is thus one of the wheel edges of the wheel or wheels of the front undercarriage, which are located at one of both sides or the furthest away from the middle of the machine. The viewing indentation according to the present invention is formed, in particular, at least with the participation of the machine frame. In particular, it is a channel in the outer contour of the rubber tire roller or machine frame, formed by a recess or an indentation of the machine frame towards the middle of the machine, in particular with respect to the outer edge of the rubber tire roller extending in the driving direction. The viewing indentation thus constitutes an area in which the width of the rubber tire roller in the horizontal plane from the lateral outer wall or lateral outer surface transversely to the direction of travel of the rubber tire roller initially narrows from the start of the viewing indentation and subsequently widens at least towards the end of the viewing indentation. The horizontal width of the rubber tire roller transversely to the direction of travel, in particular with respect to the longitudinal middle of the machine in the direction of travel, is thus less in the area of the viewing indentation than before or after the viewing indentation in the direction of travel. This is essential for an optimal use of constructional space, as the viewing indentation does not designate a tapering off of the machine in the forward or rearward direction, but explicitly a recess that is defined and delimited both in the forward and rearward direction in the direction of travel. The viewing indentation is thus, besides being open in the viewing direction (typically upward or downward), typically open to at least one further side, in particular to the surrounding environment. The lateral opening is, in particular, transverse to the forward direction of the rubber tire roller, i.e., toward the outside or away from the middle of the machine. That the viewing indentation extends from the operating platform to the wheels does not mean in this context that the viewing indentation extends into the operating platform or the driver's cabin, but merely that it can be viewed by an operator located on the operating platform, for example, through the front windshield of the operating platform through which the operator may look into or through the viewing indentation. Thus, in contrast to the tunnel of the prior art, the viewing indentation of the present invention is open on at least three sides, in particular toward the operating platform, toward the wheels and transversely to the forward direction of the rubber tire roller away from the middle of the machine to the outside. The latter opening of the viewing indentation runs, in particular, over the entire length of the viewing indentation and opens the viewing indentation from its end on the side of the operating platform to its end on the side of the wheels completely to the longitudinally lateral surrounding environment of the rubber tire roller. This way, the viewing indentation is illuminated either by daylight or by the lighting of the construction site so that normally no additional light source is required in order to make the edges or tread of the wheels visible. By means of the viewing indentations according to the present invention, the operator of the rubber tire roller can simultaneously observe the edge as well as the tread of, e.g., the left, outer front wheel and, if a viewing indentation is also present on the opposite side of the rubber tire roller, of the right, outer front wheel. If two viewing indentations are provided for the front undercarriage, the driver can thus view the opposite top sides of the front undercarriage on the left and on the right side of the machine from the operating platform. "From the operating platform" means, in particular, that the driver of the rubber tire roller sits in the driver's seat during operation and can see or observe from this position, if necessary by leaning slightly out of the operating platform, the corresponding areas through the viewing indentations. If one imagines visual rays emanating from the driver and indicating the viewing direction of the latter, the viewing indentations according to the present invention extend along said visual rays from the operating platform up to the wheels of the rubber tire roller. Reference point for the viewing conditions through the viewing indentation in accordance with the invention is thus the height of the eyes of the operator on the operating platform, in particular of an operator in the driver's seat of the operating platform. This is determined precisely and defined by means of the so-called FPCP ("filament position centre point") in accordance with DIN ISO 5006 "Earth-moving machinery—Operator's field of view—Test method and performance criteria". The viewing conditions obtained via the viewing indentation in accordance with the invention thus relate to this point.

A viewing indentation on opposite sides of the rubber tire roller is preferably provided for each side of the rubber tire roller and accordingly for each of the two outer face sides of the front undercarriage. Thus, both face sides of the front undercarriage and a part of the tread of the outer wheels of the front undercarriage are visible from the operating platform. The two viewing indentations for the front undercarriage are, in particular, configured to be identical with one another in this case, said indentations being mirrored on a vertical plane running parallel to the machine frame. The formation of the viewing indentations according to the present invention as embrasures or channels or recesses formed in the machine frame allows a particularly simple configuration of the machine frame without additional constructional elements, by which means manufacturing costs for the rubber tire roller according to the present invention are kept low.

As a result of the special viewing conditions obtained by means of the viewing indentation in accordance with the invention, maneuvering of the rubber tire roller during operation is substantially improved, as the driver is able to view at least one and, in particular, both (in the case of two viewing indentations) outer wheels of the undercarriage, viewed transversely to the forward direction, or their face sides extending in the forward direction. Here it is preferred if the viewing indentation extends from the outer side in the horizontal plane far enough toward the middle of the machine that the driver can view at least a third, in particular at least the half and especially the complete width of the rubber tire in question from the FPCP. Additionally, or alternatively, the viewing indentation is further preferably configured in such a way that the driver, especially from the FPCP, views the external surface of the rubber tire and/or at least partially the area above the vertical center of the outer tire surface in a virtual, vertical reference plane from above. This way, besides having an improved view of the side edges, the driver can recognize particularly quickly if there is, e.g., material adhering to the treads of the rubber tires and accordingly adjust e.g. suitable process parameters (separation agent mixture, spraying device, driving speed, etc.). The viewing indentations thus contribute significantly to an improvement of the process.

However, an even more precise control of the path of the rubber tire roller can be attained when at least one further viewing indentation is provided, through which at least one of the outer wheels of the rear undercarriage can be viewed. It is thus preferred to have a third viewing indentation for the rear undercarriage configured in the machine frame, wherein the third viewing indentation allows a continuous, unobstructed view from the operating platform to the rear wheels and is preferably configured to be open to one side over its entire extension, wherein an outer wheel edge and a wheel tread of the at least one wheel of the rear undercarriage can be viewed by a driver of the rubber tire roller through the third viewing indentation. The configuration of the third indentation corresponds to the configuration of the viewing indentations for the front undercarriage described above. Through the third viewing indentation, the driver can observe one of the outer rear wheels, in particular its edge and tread, and control the motion of the rubber tire roller at the rear wheel as well. According to a further embodiment of the present invention, a total of four viewing indentations are provided, two for the front undercarriage and two for the rear undercarriage, and the driver is able to view all edges and treads of the outer wheels, both at the front and in the rear as well as left and right on the rubber tire roller. In particular, the viewing indentations for the front and rear undercarriages are respectively identical and their configurations mirror each other. As a result of the extended visibility, the rubber tire roller can be controlled by the operator particularly advantageously and simply. Whenever the term "viewing indentations" is used in the following, it refers to the at least one viewing indentation or to the viewing indentations present on the rubber tire roller in question.

In principle, it would be best for the visibility of the wheels to reduce the machine frame of the rubber tire roller to a skeleton carrier frame and thus provide the driver with an unobstructed view of all wheels. However, as already described above, the machine frame of the rubber tire roller not only serves to increase the machine weight as far as possible in order to set the wheel load for a desired ground compaction performance, but rather the machine frame carries further essential components, such as the power unit or a water tank for wetting the tread of the wheels, the latter defining the size and shape of the machine frame in question by means of their dimensions. Ultimately, a compromise must be found between the visibility of the wheels through the viewing indentations and the necessary size of the machine frame. In other words, the machine frame cannot be reduced toward the middle of the machine to an arbitrary extent in order to create a viewing indentation for the driver. Preferably, the viewing indentations provided are formed in such a way that the machine frame is only reduced toward the middle of the machine in sections and protrudes laterally outward beyond the viewing indentations in the remaining areas of the outer contour of the rubber tire roller. The machine frame thus forms all side walls of the viewing indentations and limits them. In particular, it is preferred for at least one viewing indentation to be limited in the forward direction to the front and/or to the rear by side walls formed by the machine frame. This allows the driver to have an unobstructed view of the relevant wheels of the rubber tire roller through the viewing indentations, and sufficient space is provided within the machine frame for the components of the rubber tire roller housed therein. In particular, components of the rubber tire roller can be housed in the machine frame in the regions protruding beyond the viewing indentations transversely with respect to the forward direction, in particular tanks, by which means less construction space is lost according to the present invention. For example, the viewing indentations are configured as channels formed in the machine frame and thus in the outer contour of the rubber tire roller, by which means the loss in construction space within the machine frame is exactly as large as necessary in order to provide the driver with an efficient viewing channel.

In principle, the side walls of the viewing indentation formed by the machine frame may extend in varying manners in relation to one another, e.g., obliquely. However, it has proven particularly advantageous for the visibility conditions through the viewing indentation if the front and rear side walls—viewed in the forward direction—of the viewing indentation formed by the machine frame run parallel to one another. In particular, this means that the viewing indentation has a constant diameter in the viewing direction of the driver, i.e., in the direction from the operating platform to the different wheels. This ensures an unobstructed view of the wheels for the driver from the operating platform.

Ideally, the viewing indentation is configured in such a way that the ground area lying in front of the rubber tire roller beyond the tread of a tire can be viewed by an operator on the operating platform through the viewing indentation. For the definition of the required viewing beam of the operator on the operating platform, reference is made here in particular to the so-called FPCP (filament position center point) in accordance with ISO 5006:2017. This document norms a viewing starting point for an operator sitting in a driver's seat on the operating platform. In this preferred embodiment, the driver can thus look through the viewing indentation over at least a part of the tire tread obliquely downward and thus see a ground area lying essentially directly in front of or at least very close to the front of the rubber tire roller. This is, in particular, advantageous when the driver would like to drive close to an obstacle, e.g., a paving screed of a road paver. The viewing indentation extends in the forward direction far enough that a viewing channel from the FPCP is created, stretching from the FPCP through the viewing indentation past the rubber tire roller, ideally over the tread of the rubber tire, to the ground area lying in front of the rubber tire roller in the direction of travel.

Several devices of the rubber tire roller are arranged on the machine frame, in particular on the front end of the machine frame in the forward direction, such as headlamps, rearview mirrors, etc. It is thus preferred, in particular for the at least one viewing indentation for the front undercarriage, if the viewing indentation is limited at the front and at the rear, viewed in the forward direction, by side walls formed by the machine frame so that the machine frame protrudes beyond said viewing indentation in the front and rear, viewed in the forward direction, thus making construction space available for further devices, for example, as a mount for headlamps and/or mirrors. In contrast, it has proven sufficient in the rear, i.e., at the back of the rubber tire roller, viewed in the forward direction, if the viewing indentation for the rear undercarriage is delimited in the forward direction to the front by a side wall formed by the machine frame and open to the rear. In other words, the viewing indentation for the rear undercarriage is a narrowing of the machine frame that continues to the rear of the rubber tire roller. Accordingly, the machine frame of the rubber tire roller does not protrude behind the viewing indentation for the rear undercarriage, but rather ends in a plane with the inner wall of the viewing indentation, recessed toward the machine center. The viewing indentation for the rear undercarriage is thus configured in a particularly generous manner so that the driver of the rubber tire roller is able to view the edge and tread of the outer rear wheel particularly well.

In principle, the viewing indentations could reveal any place on the wheels where the wheel edges and tread surfaces are visible, for example, in the area of the tread surfaces located in the rear when viewed in the forward direction. A tracking of the steering angle and thus an improved control of the steering of the corresponding rubber tire roller is particularly successful if the vertical upper side of the tread of the wheels, i.e., the side facing away from the ground in during operation, can be viewed by an operator from the operating platform. In order to ensure this, it is preferred for the viewing indentations to extend through the machine frame also vertically above the wheels. The viewing indentations thus end, for example, in the wheel housing in the area above a wheel facing away from the ground during operation of the rubber tire roller. The upper surfaces of the wheels, i.e., their tread surfaces and their outer edges running transversely to the forward direction, can be viewed best from this point.

Usually, rubber tire rollers or their machine frames comprise a hood in front of and/or behind the operating platform in the forward direction, e.g., an engine hood and/or a tank, for example, a water tank. These hoods can be opened up or pivoted so that access to components arranged within the machine frame of the rubber tire roller, for example, for maintenance work, is provided. If the machine frame comprises a hood in front of and/or behind the operating platform in the forward direction, it is preferred for the viewing indentations to extend through the hood. The contour of the viewing indentations or the viewing indentations per se are thus not only formed by the machine frame itself, but also by the hoods arranged on the machine frame, i.e., their contour is continued by a corresponding design of the hoods. All lateral surfaces and inner surfaces of the viewing indentations formed by the machine frame thus also continue in the hood or hoods. As a result, the present invention can also be realized with rubber tire rollers having such hoods. Additionally, or alternatively, a corresponding configuration of further elements, for example, tanks, is also possible.

A further option for providing sufficient construction space on the machine frame despite the viewing indentations according to the present invention consists in configuring the front and/or rear side walls, when viewed in the forward direction, of the respective viewing indentations formed by the machine frame, to be undercut. By means of the undercut, the width of the viewing indentation narrows outwards, the undercut in accordance with the present invention never effecting a complete closure of the viewing indentation to the side. In other words, the viewing indentation is configured in such a way that it enlarges or widens from the vertical plane of the outer contour of the rubber tire roller towards the middle of the machine. In this preferred embodiment, at least one viewing indentation, in particular both viewing indentations for the front undercarriage, undercuts the machine frame in such a way that the viewing indentation is partially configured to be limited to one side by the machine frame. This undercut describes the viewing indentation and, in particular, the part of the viewing indentation covered or limited to the outside by an overhang of the machine frame. Such an undercut can be configured by an oblique side wall or by an additional element arranged to the outer side of the viewing indentation, for example, a piece of sheet metal.

In modern rubber tire rollers, the undercarriages typically comprise several wheels spaced apart from one another transversely in the forward direction, the wheels of the front undercarriage being arranged transversely to the forward direction in an offset manner relative to the wheels of the rear undercarriage in the gaps of the latter. In other words, the wheels of the undercarriages are arranged in an offset manner transversely to the forward direction so that the ground of the roller's path is essentially passed over by one wheel only when the rubber tire roller drives over it, although naturally a certain path overlap is envisaged in order to achieve a homogenous compaction. If the rotational axes of the front and rear undercarriages are projected over one another, there is an alternating overlap of a front and a rear wheel, i.e., the front wheels lie essentially in a gap between two rear wheels and vice versa. Such an arrangement of the wheels of the front and rear undercarriages automatically results in one wheel of the rear undercarriage projecting further outwards on one side of the rubber tire roller transversely to the forward direction than the wheels of the front undercarriage and vice versa. It is thus preferred for the viewing indentation for the rear undercarriage to be directed to this wheel edge, i.e., the wheel edge offset to the outside in relation to the front wheel edge. In other words, the viewing indentation for the rear undercarriage should be arranged specifically on the longitudinal side of the rubber tire roller on which the outermost wheel edge of the rear undercarriage, viewed transversely to the forward direction, protrudes beyond the outermost wheel edge of the front undercarriage. As this wheel edge of the rear undercarriage defines an outer edge of the path of the entire rubber tire roller, it is of particular importance during operation, in particular for steering the rubber tire roller exactly along a predetermined path. It is thus advantageous if, in addition to the edges of the outer wheels of the front undercarriage arranged transversely to the forward direction, the edge of this wheel can also be viewed from the operating platform during operation.

The operating platform itself should also be configured so as to permit the driver an unobstructed view through the viewing indentations. For the most part, operating platforms of rubber tire rollers are equipped with a cabin comprising a roof. In such rubber tire rollers, the operating platform comprises support bars which support the roof. These bars essentially rise upwards and are made of a non-transparent material, usually steel. In order to provide the driver with an unobstructed view through the viewing indentations despite said support bars, it is preferred for the support bars, at least in the driver's field of vision, to be arranged toward the middle of the machine transversely to the forward direction relative to the viewing indentations so that the viewing indentations can be viewed in an unobstructed manner from the operating platform by the driver of the rubber tire roller. In principle, it would also be possible for the support bars to be arranged transversely to the forward direction to the outside so that an unobstructed view through the viewing indentations is obtained. However, it is preferred in accordance with the present invention that the support bars are arranged toward the middle of the machine, i.e., away from the outer edge of the rubber tire roller, in particular towards the center. This way, firstly, a secure mounting of the driver's cabin or of the roof of the driver's cabin can be attained, while it is simultaneously ensured that the support bars do not obstruct the view of the driver from the operating platform or from the driver's seat through the viewing indentations.

Rubber tire rollers comprise various devices that have to be reached by an operator, e.g., for maintenance purposes on their vertically upward side, i.e., their top side or side facing away from the ground to be compacted during operation. For the most part, rubber tire rollers comprise a water tank in which water is carried for wetting the rubber tires. The cover for this tank is often located on the top side of the rubber tire roller. These devices on the vertically upward side of the rubber tire roller are often arranged relatively high up and are thus hard to access. The present invention now permits a simplified operation of the rubber tire roller during maintenance work. For this purpose, in one embodiment of the present invention, at least one viewing indentation, in particular a viewing indentation for the front undercarriage, is configured to be open at the top. The viewing indentation is thus, at least partially, not limited upwards by the machine frame or other projecting parts of the rubber tire roller. In other words, a part of the viewing indentation forms a notch that is open at the top or a recess in the machine frame. This notch or recess is located, in particular, in an area in which a device that has to be reached by an operator from time to time is arranged on the vertically upper side. As a result of the notch according to the present invention, it is easier for the operator to reach this device, as it is possible to lean, for example, with the torso, into the notch, by which means it is possible to reach the top of the machine frame. This way, the machine operator can reach points closer to the middle of the machine center than in conventional forms of the machine frame. An operator standing next to the rubber tire roller can also reach devices on the rubber tire roller that are arranged high up.

This effect can be further enhanced by providing a step for an operator, in particular in the region of the viewing indentation configured to be open at the top. The step denotes, in particular, a platform or foothold on which the operator can place at least one foot or even two feet. In this case, the step is arranged at a certain distance from the ground on the machine frame so that the operator can reach the devices arranged vertically high up on the rubber tire roller a lot easier by climbing on the step. The step is particularly helpful wherever the viewing indentation configured to be open at the top is located. Together with the viewing indentation open at the top, the step makes it considerably easier to reach the devices of the rubber tire roller that are arranged high up.

Reaching devices arranged higher up on the rubber tire roller can be made still easier in a further embodiment by configuring a step recess in the machine frame in addition to the viewing indentation, in particular vertically above the step, said step recess preferably being configured in the viewing indentation. The step recess is also configured as an indentation in the machine frame and preferably extends from the vertically lower end of the rubber tire roller or from the step over the entire height of the rubber tire roller vertically upward. This embodiment can be realized in a particularly advantageous manner if the step recess, in particular in the vertically top region of the rubber tire roller, is combined with the viewing indentation, by which means a certain area of the viewing indentation or step recess is used both as a step for an operator as well as for the driver's view of the wheels. As a result of this dual use of one and the same indentation in the machine frame, the construction space for the machine frame is only limited once and thus less than it would be if both indentations were formed separately in the machine frame. The step recess is configured in such a way that an operator either standing next to the rubber tire roller or on the step can enter the step recess and thus reach over the outer contour of the machine toward the middle of the machine. This way, it is considerably easier for the operator of the rubber tire roller to reach devices that are hard to reach, e.g., which are arranged vertically high up, than would be the case if he or she were merely standing next to the rubber tire roller, in particular outside the outer contour of the same. A particularly advantageous accessibility of these devices is attained by combining a viewing indentation that is vertically open at the top with a step recess in a particularly advantageous embodiment of the present invention. This renders handling of the rubber tire roller considerably easier, in particular during maintenance works.

Preferably, an access cover, in particular for an operating fluid tank or a ballast tank, is arranged in the at least one viewing indentation for the front undercarriage. This arrangement is, firstly, easy to reach from outside the rubber tire roller and, secondly, has the advantage that is does not protrude beyond the outer side of the machine. Typical operating fluids can be water, oil or other operating fluids, for example. Alternatively, or additionally, the arrangement of an access to a ballast device at this location is particularly advantageous. This can be a ballast space for sand or other ballast materials. Preferably, it is a ballast tank for water.

In order to be able to use them on construction sites in confined conditions as well, rubber tire rollers are often suspended by means of a crane and moved by the latter. In order to permit such a suspension, fastening means must be provided on the rubber tire roller for the crane. In order to permit a balanced suspension, the fastening means for the crane typically have to be arranged in the regions of the rubber tire roller in which the viewing indentations are arranged in accordance with the present invention. It is thus necessary, firstly, to provide suitable fastening means and, secondly, not to restrict the view of the operator of the rubber tire roller through the viewing indentations as a result of the fastening means. It is thus preferred to have transport loops arranged in the side walls of the viewing indentations formed by the machine frame for suspending the rubber tire roller. For reasons of balance, it is also advantageous if the transport loops are configured to be as far away as possible from the middle of the machine, i.e., on the outer contour of the rubber tire roller. The transport loops are thus preferably arranged at the junction of the side walls of the viewing indentations and the outer contour of the rubber tire roller. In particular, the transport loops are configured as an integral part of the machine frame.

BRIEF DESCRIPTION OF THE DRAWINGS

In the following, the present invention is described in greater detail by means of the illustrative embodiments shown in the figures, which show schematically.

Components that are identical or have identical functions are designated with the same reference numbers. Repetitive components are not necessarily indicated separately in each figure.

DETAILED DESCRIPTION OF THE INVENTION

Figure 1:
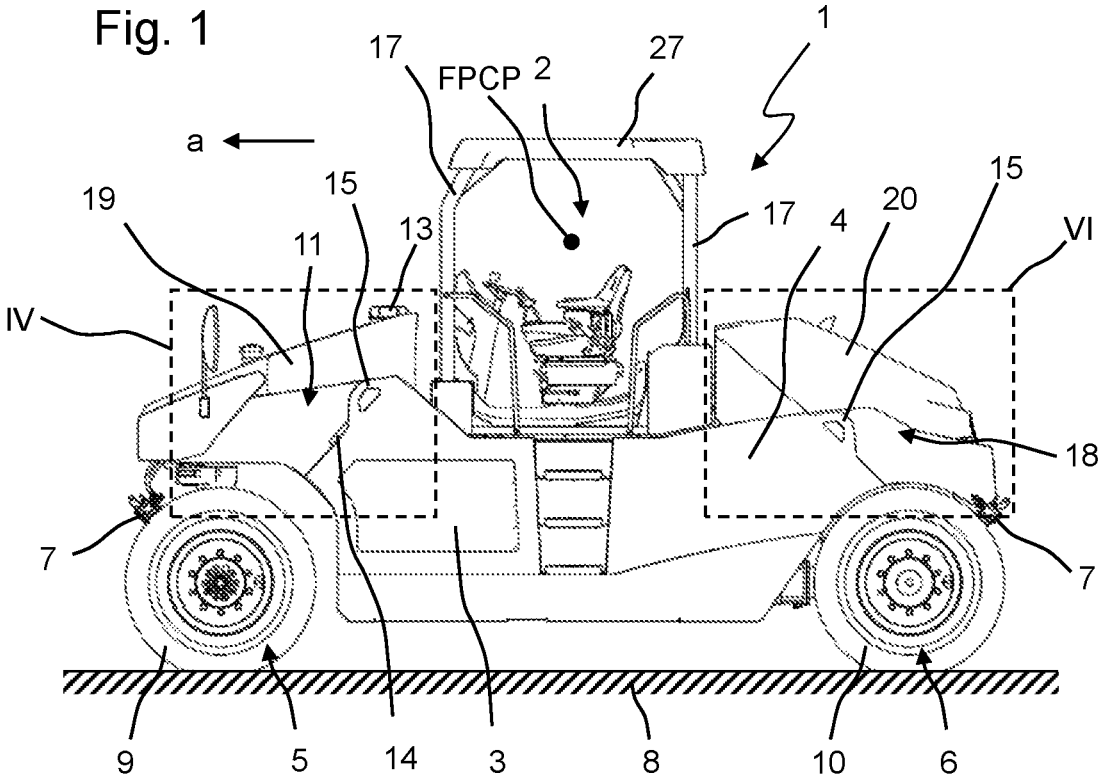
FIG. 1 is a side view of the rubber tire roller.

FIGS. 1 to 11 show a preferred illustrative embodiment of a rubber tire roller 1 according to the present invention. Generally, rubber tire rollers 1 comprise an operating platform 2 and a machine frame 3. During operation, the rubber tire rollers 1 are driven by a power source 4, mostly a diesel engine, and move alternately in the forward direction a or contrary to the forward direction a over the ground 8 by means of a driven front undercarriage 5 and a rear undercarriage 6. The undercarriages 5 and 6 respectively comprise four individual wheels arranged next to one another. Ideally, a driver's seat that is displaceable over the width of the platform is arranged on the operating platform 2. In FIG. 1, an approximate position of the FPCP in accordance with DIN ISO 5006:2017 is indicated for illustrative purposes.

In order to render the steering of the machine easier for the driver of the rubber tire roller 1, the embodiment of the rubber tire roller 1 shown comprises two viewing indentations 11 for the front undercarriage 5. More specifically, the machine frame 3 of the rubber tire roller 1 comprises a viewing indentation 11 through which, from the operating platform 2 of the rubber tire roller 1, the driver can view the wheel 9 located on the outer right, in particular its wheel edge A transverse to the forward direction a and tread. Moreover, the machine frame 3 of the rubber tire roller 1 comprises a further viewing indentation 11, through which the outer wheel arranged on the front left of the front undercarriage 5 can be viewed from the operating platform 2. Here as well, the outer wheel edge B located on the front left and the tread of the outer wheel 9 on the front left are visible for the driver from the operating platform 2. As can be seen, in particular, in FIG. 2, the viewing indentations 11 for the front undercarriage 5 are located on the opposite longitudinal sides of the machine frame 3 of the rubber tire roller 1 and essentially at the same position in the longitudinal direction or forward direction a of the rubber tire roller 1.

Furthermore, the rubber tire roller 1 comprises a third viewing indentation 18 for the rear undercarriage 6. Through the viewing indentation 18, the tread and the wheel edge C of the left outer rear wheel 10 is visible for the driver. The wheel edges A, B, C are thus the wheel edges located farthest away from the middle of the machine of the rubber tire roller 1 in a direction transverse to the forward direction a. As the driver of the rubber tire roller 1 is able to view these wheel edges A, B, C during operation, the rubber tire roller 1 can be steered particularly easily. Furthermore, the tread of the respective wheels 9, 10 can also be viewed via the viewing indentations 11, 18 so that the driver of rubber tire roller 1 can determine if ground material, in particular, e.g., asphalt, is adhering to the tread of the wheels 9, 10. In case material is actually sticking to the wheel tread, stripping devices 7 are provided, which can at least partially remove the adhering material from the wheel tread.

Figure 3:
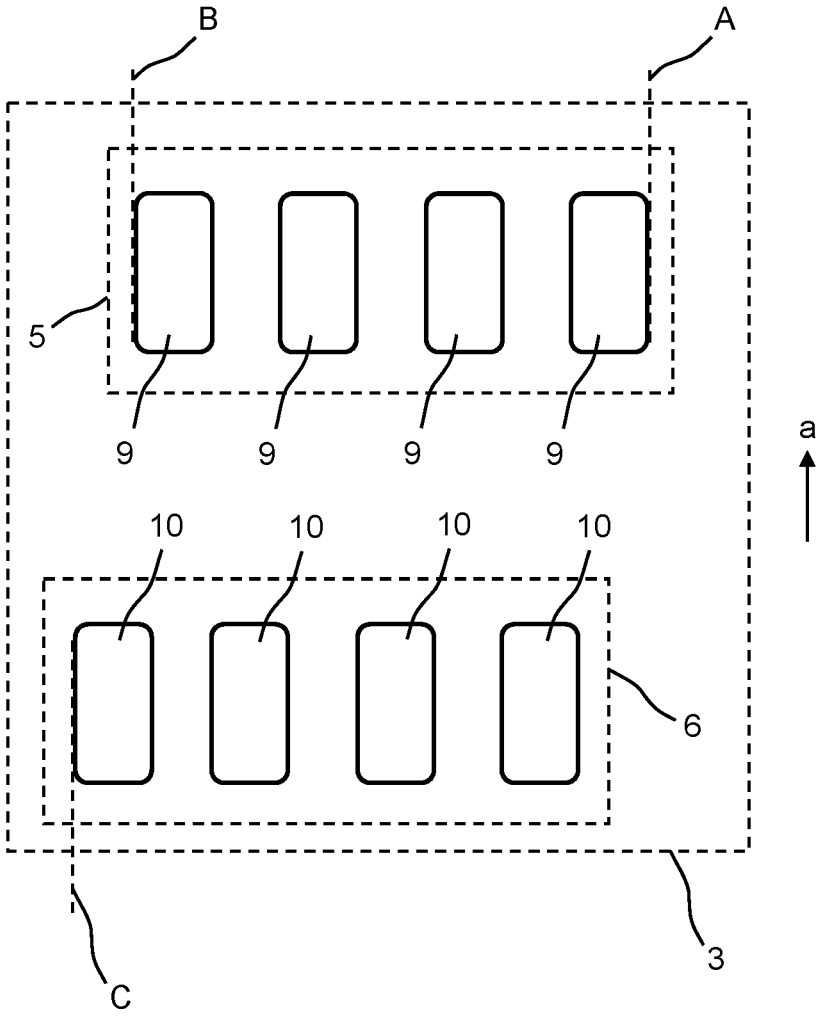
FIG. 3 is the offset between the front and rear undercarriages of the rubber tire roller.

As a result, a total of three outer wheel edges A, B, C, and in part the corresponding wheel treads, can be viewed by the driver from the operating platform 2 by means of the exactly three viewing indentations 11, 18. The selection of the three wheel edges A, B, C from all four theoretically selectable wheel edges is described in further detail by means of FIG. 3. FIG. 3 schematically shows the positions of the front wheels 9 of the front undercarriage 5 relative to the rear wheels 10 of the rear undercarriage 6 in a top view. In the illustrative embodiment shown, the front undercarriage 5 comprises four front wheels 9 and the rear undercarriage 6 comprises four rear wheels 10. The front wheels 9 and the rear wheels 10 are respectively spaced apart from one another transversely to the forward direction a. The front wheels 9 are arranged in the gaps in relation to the rear wheels 10 transversely to the forward direction a. This means that the front wheels 9 are arranged at an offset transversely to the forward direction a with respect to the rear wheels 10 in such a way that the paths of the individual wheels respectively only overlap at their edges and that the a portion of the ground 8, when passed over once by the rubber tire roller 1, is essentially driven over by one wheel 9, 10 only, belonging either to the front undercarriage 5 or to the rear undercarriage 6. As the rubber tire roller 1 is typically steered by means of the front undercarriage 5, the wheel edges A, B arranged on the outside and transversely to the forward direction a are of particular importance for a precise control and steering of the rubber tire roller 1. Moreover, the wheel edge C of the left rear wheel 10 protrudes further outward transversely to the forward direction a than the wheel edge B of the outer left front wheel 9 as a result of the offset of the rear wheels 10 in relation to the front wheels 9 transversely to the forward direction a. The wheel edge C of the wheel 10 is thus located the farthest outwards on the rear undercarriage 6 transversely to the forward direction a and thus marks the outer limit of the overall path of the rubber tire roller 1 at the rear on the left. The wheel edge C of the rear undercarriage 6 is thus also of particular importance for steering the rubber tire roller 1, in particular for maneuvering the rubber tire roller 1 along a predefined path and/or along obstacles. The fourth wheel edge at the rear on the right, in contrast, is offset transversely to the forward direction a towards the middle of the machine in relation to the front outer right wheel edge A and thus automatically always lies within the overall path of the rubber tire roller 1. This wheel edge is thus less important for maneuvering or steering the rubber tire roller 1 and does not necessarily need to be viewable through a viewing indentation. The preferred embodiments of the present invention are thus limited to exactly three viewing indentations 11, 18, through which the specific wheel edges A, B, C are visible.

Figure 2:
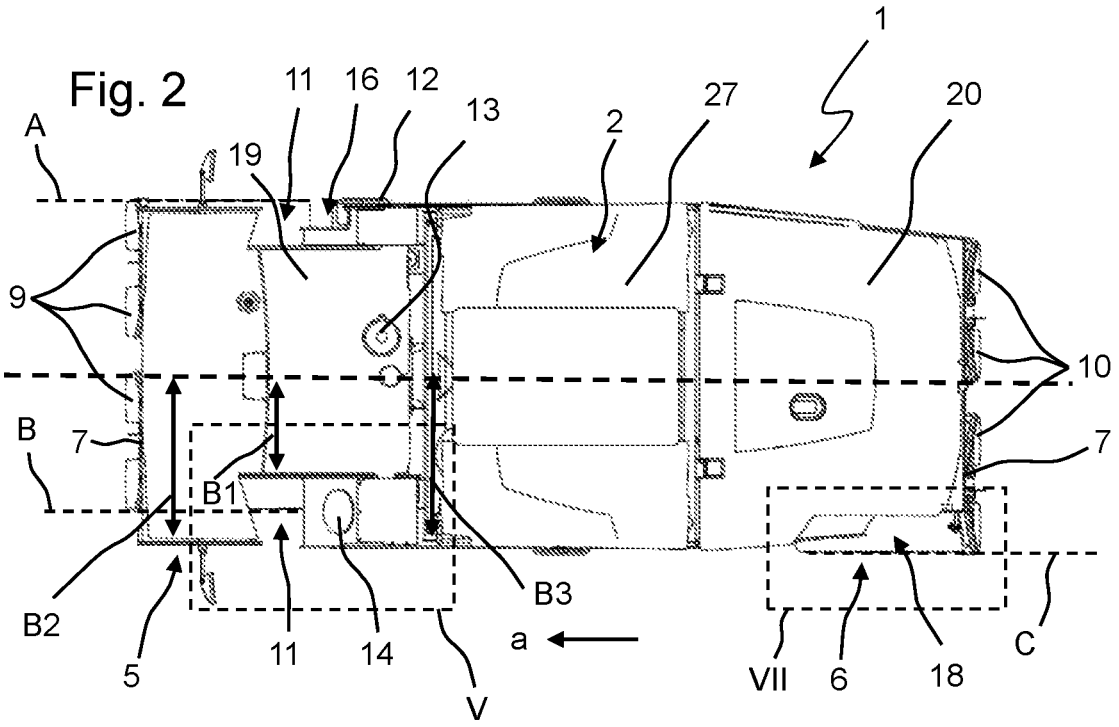
FIG. 2 is a top view on the rubber tire roller shown in FIG. 1.
Figure 4:
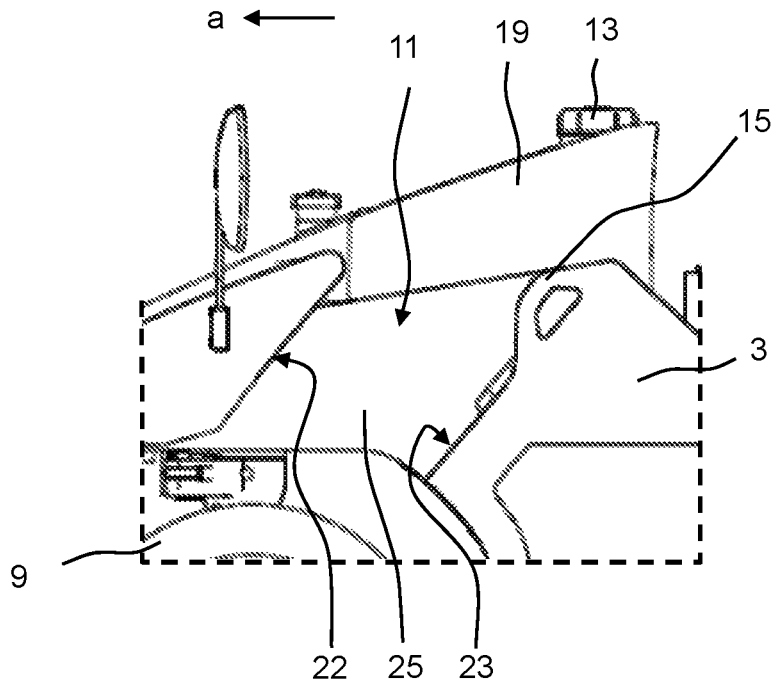
FIG. 4 is a side view of a viewing indentation for the front undercarriage.
Figure 5:
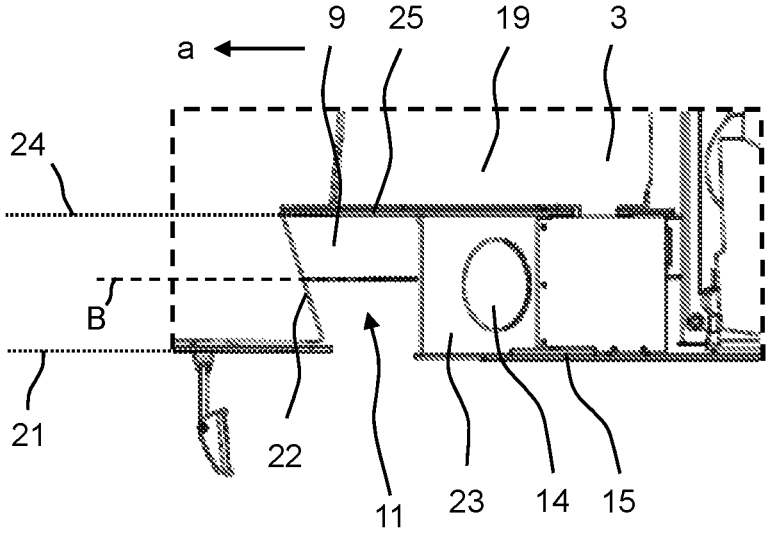
FIG. 5 is a top view of a viewing indentation for the front undercarriage.

FIGS. 4 and 5 show a detailed illustration of a viewing indentation 11 for the front undercarriage 5 in accordance with the boxes IV and V indicated in FIGS. 1 and 2. The second viewing indentation 11, located at the front on the right in the forward direction a, is configured to be essentially identical to the viewing indentation 11 shown so that the indications given below also apply to the second viewing indentation 11 located at the front on the right on the rubber tire roller 1 in the forward direction a. FIG. 4 shows a side view of the viewing indentation 11, while FIG. 5 shows a top view. The viewing indentation 11 is formed by the machine frame 3. In particular, the viewing indentation 11 is formed as a recess in the machine frame 3. It extends continuously from the wheels 9 to the operating platform 2. The viewing indentation 11 ends vertically above the wheels 9, in particular in the wheel house of the wheels 9. The formulation that the viewing indentation 11 "runs continuously to the operating platform 2" means that there is no obstacle to impede a driver's view of the wheels 9 from the operating platform 2 (FPCP) through the viewing indentation 11 in a virtual extension of the viewing indentation 11 towards the operating platform 2, in particular along the viewing direction of a driver located on the operating platform 2. The viewing indentation 11 thus forms a free space between the operating platform 2 and the wheels 9, through which the driver can see the wheels 9 from the operating platform 2. The operating platform 2 does not have to be open in extension of the viewing indentation 11, but rather it is sufficient that the driver can look through the viewing indentation 11 from the operating platform 2, e.g., through a window or a front or rear windshield of the of the operating platform 2. The viewing indentation comprises a front lateral wall 22 located in the forward direction a in the front and a rear lateral wall 23 located in forward direction a in the rear. Moreover, the viewing indentation 11 is delimited by an inner wall 25 toward the middle of the machine, i.e., transversely to the forward direction a. Opposite the inner wall 25, the viewing indentation 11 is open towards the outer environment, in particular over its entire length. The front side wall 22, the rear side wall 23 and the inner wall 25 are respectively formed by or are a part of the machine frame 3. The front side wall 22 and the rear side wall 23 run in the direction of or parallel to the driver's viewing direction from the operating platform 2 when the latter, sitting, e.g., in the driver's seat, looks toward the wheels 9, which can be viewed through the viewing indentation 11. In particular, the front lateral wall 22 and the rear lateral wall 23 also extend parallel to one another, as shown in FIG. 4.

As shown in FIG. 5, the side walls 22, 23 of the viewing indentation 11 extend from a machine frame outer edge 21 to a machine frame inner edge 24 formed by the inner wall 25. The machine frame inner edge 24 and the machine frame outer edge 21 essentially extend parallel to the forward direction a as well as parallel to one another. The machine frame outer edge 21 constitutes the edge of the machine frame 3 located the furthest outwards, i.e., transversely to the forward direction a. In other words, the machine frame outer edge 21 of the machine frame 3 is located the furthest away from the center of the machine, in particular transversely to the forward direction a. The distance between the machine frame outer edge 21 and the machine frame inner edge 24 is the depth of viewing indentation 11. The depth of viewing indentation 11 is essentially defined by the extension of the side walls 22, 23 transverse to the forward direction a. The front side wall 22 and the rear side wall 23 can essentially extend in a direction transverse to the forward direction a. As indicated in FIGS. 4 and 5, the rear side wall 23 extends along the viewing direction of the driver and essentially transversely to the forward direction a. The front side wall 22, in contrast, extends not only transversely to the forward direction a, as is evident, in particular, in FIG. 5, but also toward the middle of the machine center and in the forward direction a. Side walls 22, 23 run from the machine frame outer edge 21 to the machine frame inner edge 24, which is essentially formed by the inner wall 25. As is evident from FIG. 5, the front side wall 22 extends obliquely between the machine frame outer edge 21 and the machine frame inner edge 24 in such a way that the viewing indentation is configured to widen from the machine frame outer edge 21 toward the machine frame inner edge 24 or from the outer side of the rubber tire roller 1 toward the middle of the machine. As a result of the extension of the front side wall 22 transverse to the forward direction a and in the forward direction a, an overhang of the machine frame 3 occurs in the area of the viewing indentation 11, the overhang being configured in such a way that the viewing indentation 11 is also at least partially limited by the machine frame 3 transversely to the forward direction and away from the center of the machine. In other words, the limitation is arranged in the region opposite the inner wall 25. However, it should be noted that this limitation does not close the opening of the viewing indentation 11 opposite the inner wall 25 toward the external environment. As a result of this special arrangement of the machine frame 3 in the region of the viewing indentation 11, construction space is saved while a visually appealing design of the viewing indentation 11 is attained.

It is thus important that the width B of the rubber tire roller in a virtual horizontal reference plane transverse to the direction of travel a is smaller in the area of the viewing indentation 11 (width B1) than it is before (width B2) or after (width B3) the viewing indentation 11 in the direction of travel. The viewing indentation thus does not constitute a tapering off of the machine in the forward or rearward direction, as is the case, e.g., with the lateral recess 18 described below in greater detail. Rather, the viewing indentation 11 has a front and a rear delimiting wall in the direction of travel, which extend at least obliquely in relation to the direction of travel. The machine is thus narrower with respect to its horizontal width, when viewed in the direction of travel, over the viewing indentation 11 in relation to the starting width before the area of the viewing indentation, and subsequently broader, in the present case as wide as before the indentation.

In this context, FIG. 2 makes it clear that the viewing indentation recesses from a maximal outer side wall extension far enough toward the middle of the machine that more than half and in particular more than two-thirds of the tread width of the rubber tire on the outer, right-hand side is visible.

Figure 6:
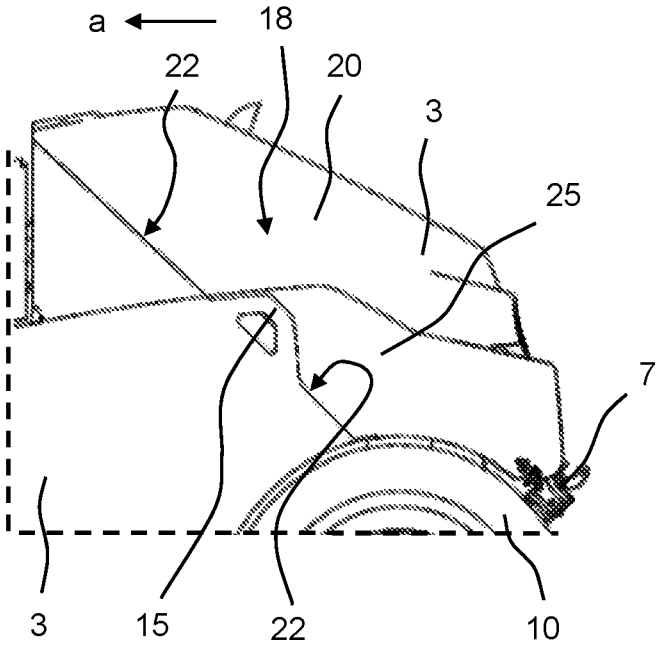
FIG. 6 is a side view of a viewing indentation for the rear undercarriage.
Figure 7:
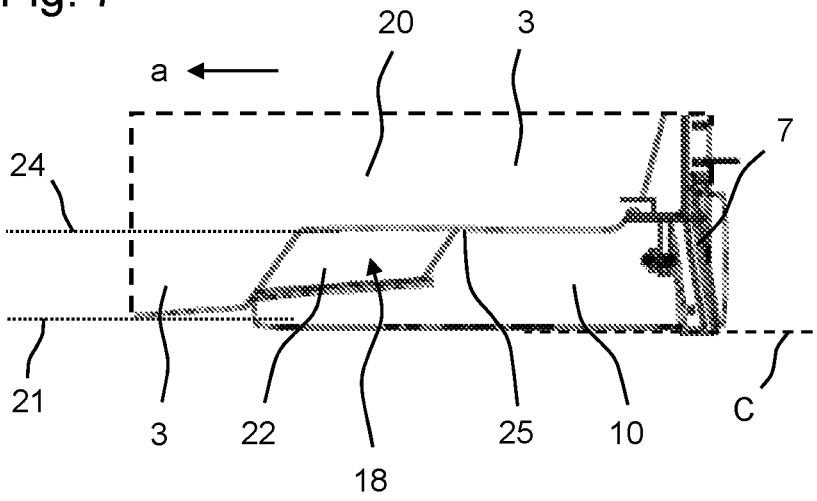
FIG. 7 is a top view of a viewing indentation for the rear undercarriage.

FIGS. 6 and 7 show a side view and a top view of the viewing indentation 18 of rubber tire rollers 1 in accordance with the boxes VI and VII shown in FIGS. 1 and 2. The statements regarding the viewing indentation 11 in accordance with FIGS. 4 and 5 also apply to the viewing indentation 18 so that below mainly the differences between viewing indentation 18 and viewing indentation 11 are elucidated. The viewing indentation 18, like the viewing indentation 11, is located between a machine frame outer edge 21 and a machine frame inner edge 24. The viewing indentation 18 for the rear undercarriage 6 also comprises an inner wall 25 and a front lateral wall 22, both of which being formed by the machine frame 3. In contrast to the viewing indentation 11, the viewing indentation 18 does not have a rear side wall 23, but rather is configured to be open to the rear vis-à-vis the forward direction a. This means that the rear of the machine frame 3, in relation to the forward direction a, ends, in particular, in the upper region at the level of the machine frame inner edge 24. The front side wall 22 of viewing indentation 18 extends from the machine frame outer edge 21 to the machine frame inner edge 24, in particular in such a way that the front side wall 22 of the machine frame outer edge 21 extends transversely to the forward direction a and opposite the forward direction a to the machine frame inner edge 21. This way, there is no overhang of the machine frame 3 at the viewing indentation 18, while construction space is nevertheless saved. As is evident, in particular, from FIG. 1, the front side wall 22 has the same angle in the vertical plane as the rear side wall 23 and the front side wall 22 of the viewing indentations 11 for the front undercarriage 5. In particular, the values of the respective angles of the side walls 22, 23 in relation to a vertical plane correspond, while the extension of the side walls 22, 23 of the front viewing indentations 11 and thus also their angles relative to a vertical plane, mirror the extension and the angle in the vertical plane of the rear viewing indentation 18.

The machine frame 3 of the rubber tire roller 1 includes a front hood 19 in the forward direction a and a rear hood 20 in the forward direction a. The front hood 19 and the rear hood 20 are configured, e.g., as pivotable hoods 19, 20, which can be swiveled about a pivot axis in order to render devices mounted in the machine frame accessible for maintenance purposes. As is evident, in particular, from FIG. 2 and FIGS. 10 and 11, the viewing indentations 11, 18 continue into the hoods 19, 20. In particular, the machine frame 3 or its hoods 19, 20 of the rubber tire rollers 1 are configured in such a way that the front side wall 22, the rear side wall 23 and the inner wall 25 of the viewing indentations 11, 18 continue into the hoods 19, 20 without causing a change in the cross section or cross-sectional profile of the viewing indentations 11, 18 in the driver's viewing direction. The hoods 19, 20 are thus also configured to permit an operator to have unobstructed view of the wheels 9, 10 or the wheel edges A, B and C and tread surfaces through the viewing indentations 11, 18 from the operating platform 2 of the rubber tire roller 1.

Figure 11:
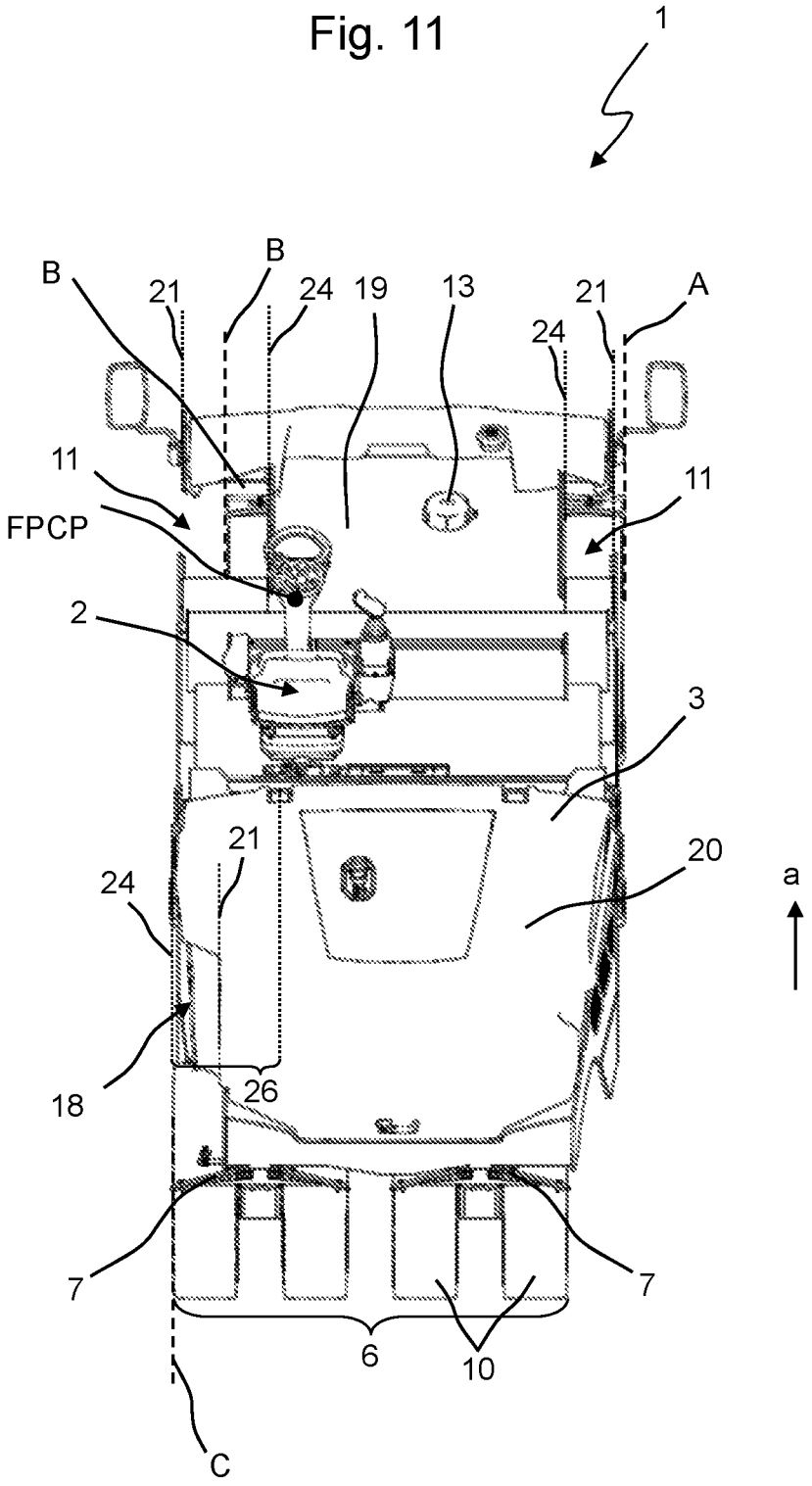
FIG. 11 is a rear view of the rubber tire roller obliquely from the top.

In particular FIG. 11, in which the top view of the machine is tilted in such a manner that the viewing beam of the operator in the driver's seat or from the FPCP extends at a very steep angle in relation to the plane of the picture, makes it clear that a viewing of the ground B beyond the rubber tire in question is possible through the viewing indentation from the FPCP. As a result, the driver can view in particular the area lying directly in front of the rubber tire roller from the driver's seat, which makes, e.g., maneuvering easier.

It is evident from FIGS. 1, 2, 8 and 9 that the rubber tire rollers 1 comprise a roof 27 for their operating platforms 2. The roof 27 is supported by support bars 17, which connect the roof 27 to the machine frame 3. In order to improve the driver's view from the operating platform 2 through the viewing indentations 11, 18, in particular through the viewing indentation 18, e.g., the support bar 17 located on the side of the viewing indentation 18 of the rubber tire roller 1, i.e., in the rear on the left, is arranged closer to the middle of the machine. Instead of arranging the support bar 17 essentially on the machine frame outer edge 21, as it is common in the prior art, the corresponding support bar is thus arranged away from the machine frame outer edge 21 towards the middle of the machine, transversely to the forward direction a, by the distance 26. The distance 26 between the machine frame outer edge 21 and the position of the support bar 17 is selected so that the operator is able to view the rear wheel 10 or the wheel edge C of the rear wheel 10 of the rear undercarriage through the viewing indentation 18 from the operating platform 2 or a position on the driver's seat. Such an offset of the support bar 17 of the roof 27 is, in particular, suitable at the rear of the operating platform 2 in relation to the forward direction a, as it needs to be ensured that the driver's view to the front through the windshield 2 in the forward direction a is as unobstructed as possible. In case the driver would like to view the left rear wheel 10 from the operating platform 2, he or she turns naturally to the left or takes a look over his or her left shoulder so that moving the support bar 17 on this side from the machine frame outer edge 21 to the middle of the machine by the distance 26 ensures an unobstructed view through the viewing indentation 18.

Figure 8:
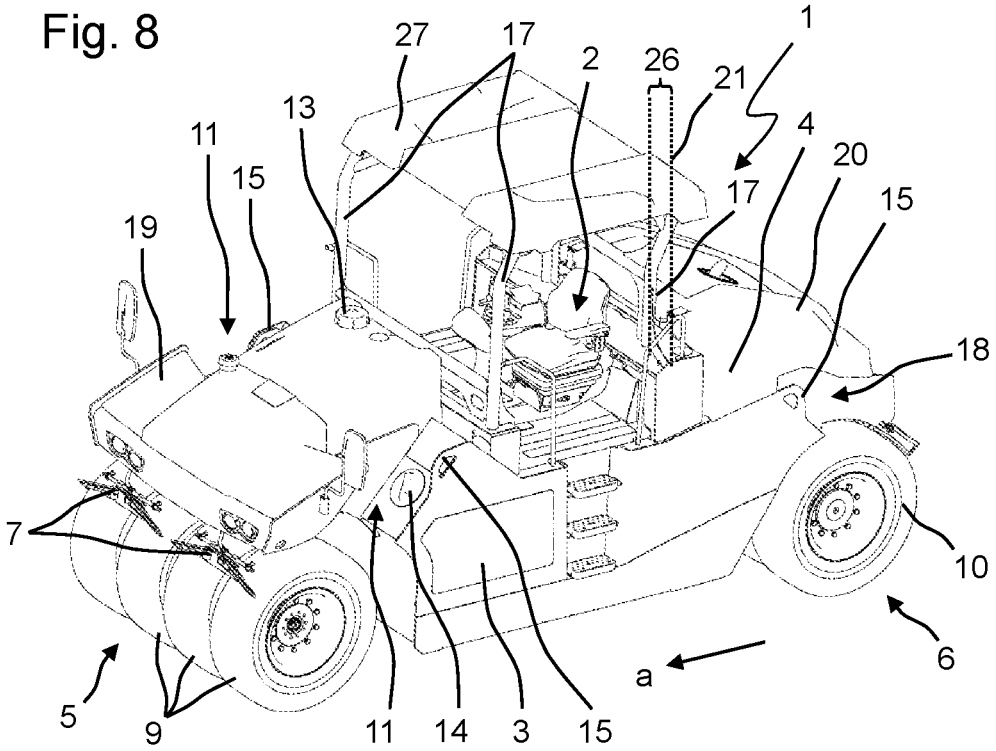
FIG. 8 is a perspective view of the rubber tire roller from the front left.
Figure 9:
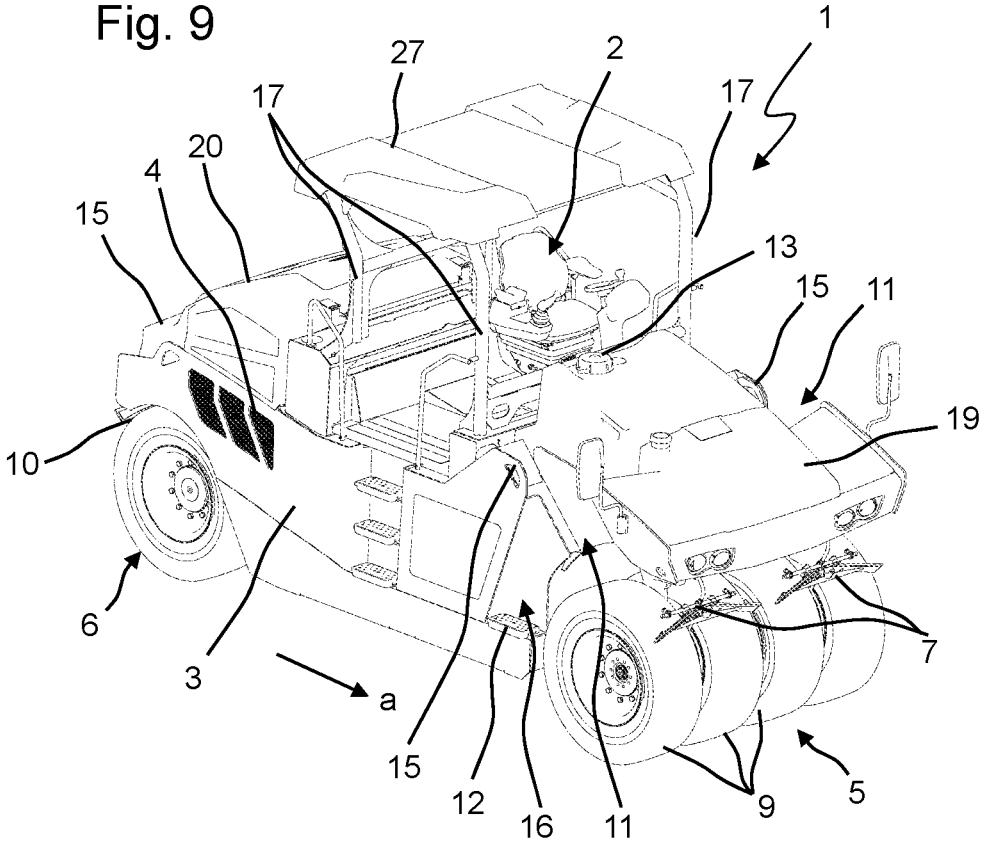
FIG. 9 is a perspective view of the rubber tire roller from the front right.
Figure 10:
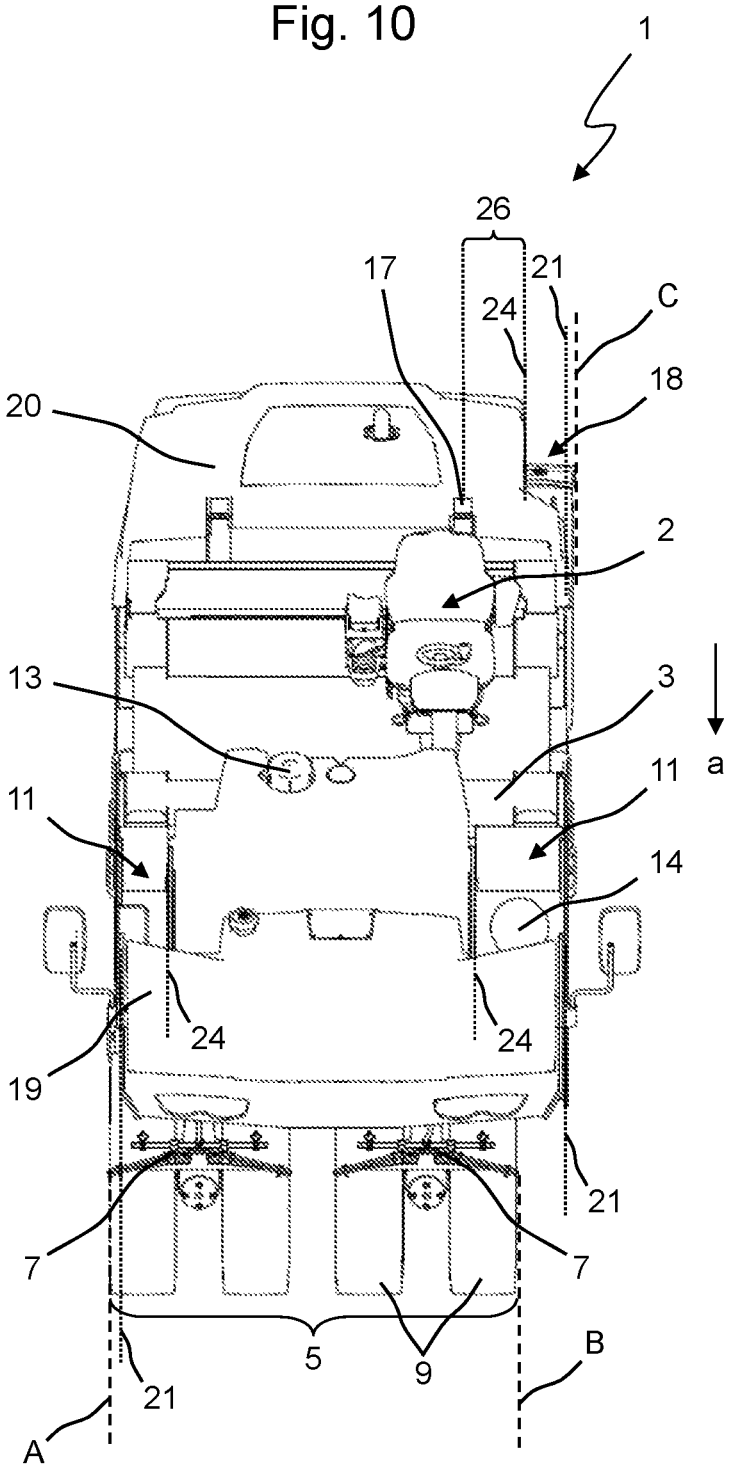
FIG. 10 is a front view of the rubber tire roller obliquely from the top.

It is further evident from FIGS. 2, 8 and 10 that a cover 14 is arranged in at least one of the viewing indentations. In the present embodiment, access to a space for ballast, in particular a ballast tank for water, is possible via said cover 14. Its placement within the viewing indentation 11, firstly, saves space and, secondly, permits a ready access from outside the rubber tire roller 1, for example, in order to fill the ballast tank.

As is evident from FIG. 2, for example, the viewing indentations 11, 18 are configured to be open at the top, i.e., on the side facing away from the ground. This means that the machine frame 3 of the rubber tire rollers 1 recedes towards the machine frame in the region of the viewing indentations 11, 18 at its upper edge, which would not be the case without the formation of the viewing indentations 11, 18. This way, it is easier for an operator to reach devices arranged on the top side of the rubber tire roller 1 or on one of the hoods 19, 20, such as, e.g., a water tank lid 13, as the operator may lean against the rubber tire roller 1 and get closer to the middle of the machine of the rubber tire roller 1 by means of the viewing indentations 11, 18 configured to be open at the top. This way, smaller operators can also easily reach devices arranged higher up on the rubber tire roller 1. This is achieved particularly advantageously, e.g., in the embodiment of a rubber tire roller 1 according to FIG. 9. In this case, a step 12 is arranged at the front right viewing indentation 11, said step 12 lying vertically below the viewing indentation 11. The step 12 here is configured as a foothold or platform on which the operator can stand if he or she wishes to access devices in the upper area of the rubber tire roller 1. This is rendered even simpler by the step recess 16 shown in FIG. 9, which is also formed by the machine frame 3 and which extends substantially vertically upwards from the step 12, i.e., away from the ground 8 and, in the embodiment shown, also in the direction of the viewing indentation 11. The step recess 16 is arranged at a viewing indentation 11, 18 and, in particular, vertically below the viewing indentation 18, 19. The step recess 16 merges with the viewing indentation 11, which is configured to be open at the top. This way, a continuous recess is created in the machine frame 3, extending vertically upwards or away from the ground and in part through the step recess 16 and in part through the viewing indentation 11. An operator may now climb or move into said recess by placing himself/herself on the step 12. As a result of the combined recess, the operator can get much closer to the middle of the machine and thus reaches devices located high up or closer to the middle of the machine of the rubber tire roller 1, which otherwise would have been hard to access, considerably easier.

The rubber tire rollers 1 of the present invention further comprise transport loops 15 for the suspension of the rubber tire roller 1, said transport loops 15 being configured so as to attach transport means to the rubber tire roller 1. This way, the rubber tire roller 1 can be lifted, e.g., by a crane and placed somewhere else when the rubber tire roller 1 is connected to a corresponding suspension means of the crane via the transport loops 15. According to the present invention, the transport loops 15 are formed by the machine frame and are, in particular, arranged in the region of the viewing indentations 11, 18. Preferably, the transport loops extend parallel to the machine frame outer edge 21 or lie in a plane with the machine frame outer edge 21. This way, the rubber tire roller 1 can be balanced particularly easily by means of the suspension on the transport loops 15, while this does not result in an obstructed view through the viewing indentations 11, 18 for the driver. In the illustrative embodiments shown in the figures, each viewing indentation 11, 18 comprises a corresponding transport loop 15.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A rubber tire roller for compacting a ground comprising:

a machine frame with an operating platform; and front and rear undercarriages supporting the machine frame the front and rear undercarriages each comprising at least one wheel, wherein at least one first viewing indentation for the front undercarriage is configured in the machine frame, the at least one first viewing indentation being configured to be open to one side over the entire length of the at least one first viewing indentation, wherein an outer wheel edge (A, B) of the front undercarriage and a tread of the at least one wheel of the front undercarriage can be viewed from the operating platform, and wherein the at least one first viewing indentation is configured in such a way that, when viewed in the forward direction, the at least one first viewing indentation initially broadens in the horizontal plane toward the middle of the machine and subsequently narrows again away from the middle of the machine.

2. The rubber tire roller according to claim 1, wherein first and second viewing indentations are configured, respectively, on each side of the rubber tire roller for the front undercarriage.

3. The rubber tire roller according to claim 1, wherein a third viewing indentation is configured in the machine frame for the rear undercarriage, wherein the third viewing indentation is configured to be open to one side over the entire length of the third viewing indentation and wherein both an outer wheel edge (C) of the rear undercarriage and a wheel tread of the at least one wheel of the rear undercarriage can be viewed from the operating platform through the third viewing indentation, and a fourth viewing indentation is provided, which is configured to be open to one side over the entire length of the fourth viewing indentation and through which the wheel edge opposite the outer wheel edge (C) and a tread of a wheel of the rear undercarriage can be observed from the operating platform.

4. The rubber tire roller according to claim 3, wherein at least one of the first, second, third and/or fourth viewing indentations is limited in the forward direction (a) to the front and/or to the rear by side walls formed by the machine frame.

5. The rubber tire roller according to claim 4, wherein in relation to the forward direction (a), the front and rear side walls of the at least one viewing indentation formed by the machine frame extend parallel to one other.

6. The rubber tire roller according to claim 1, wherein the at least one viewing indentation is configured in such a way that a ground area lying in front of the rubber tire roller can be viewed by an operator on the operating platform through the at least one viewing indentation over the upper tread of a wheel.

7. The rubber tire roller according to claim 3, wherein the third and/or fourth viewing indentation for the rear undercarriage is limited in the forward direction (a) to the front by a side wall formed by the machine frame and is open to the rear relative to the forward direction (a).

8. The rubber tire roller according to claim 3, wherein at least one of the first, second, third and/or fourth viewing indentation extends through the machine frame until vertically over the wheels.

9. The rubber tire roller according to claim 1, wherein in relation to the forward direction (a), a hood and/or a tank is arranged on the machine frame in front of and/or behind the operating platform, and in that at least one of the first, second, third and/or fourth viewing indentations extend through the hood and/or the tank.

10. The rubber tire roller according to claim 1, wherein at least one viewing indentation undercuts the machine frame in such a way that the viewing indentation is configured to be partially limited to one side by the machine frame.

11. The rubber tire roller according to claim 3, wherein the undercarriages comprise several wheels spaced apart from one another transversely to the forward direction (a), wherein the wheels of the front undercarriage are arranged so as to be offset transversely to the forward direction (a) in relation to the wheels of the rear undercarriage and in the gaps of the latter, and in that the third viewing indentation for the rear undercarriage is directed to the wheel edge (C) that is offset outwards in relation to the front wheel edge (A, B).

12. The rubber tire roller according to claim 3, wherein the operating platform comprises support bars supporting a roof, and in that the support bars are arranged transversely to the forward direction (a) toward the middle of the machine in such a way that at least one of the first, second, third and/or fourth viewing indentations can be viewed by the driver of the rubber tire roller from the operating platform in an unobstructed manner.

13. The rubber tire roller according to claim 1, wherein at least one viewing indentation is configured to be open at the top.

14. The rubber tire roller according to claim 13, wherein a step for an operator is provided in the region of the viewing indentation configured to be open at the top.

15. The rubber tire roller according to claim 1, wherein in addition to the at least one viewing indentation a step recess is configured in the machine frame which is configured to be open toward the inside of the at least one viewing indentation.

16. The rubber tire roller according to claim 1, wherein an access cover is arranged in at least one viewing indentation.

17. The rubber tire roller according to claim 1, wherein integrated transport loops for the suspension of the rubber tire roller are arranged in the side walls of the at least one viewing indentation formed by the machine frame.

* * * * *